US006405787B2

(12) United States Patent
Bizen et al.

(10) Patent No.: US 6,405,787 B2
(45) Date of Patent: Jun. 18, 2002

(54) METHOD FOR WINDING RAPIDLY QUENCHED THIN RIBBON, APPARATUS FOR PRODUCING RAPIDLY QUENCHED THIN RIBBON, AND RAPIDLY QUENCHED THIN RIBBON COIL

(75) Inventors: Yoshio Bizen; Michihiro Nagao; Jun Sunakawa, all of Shimane-ken; Shunsuke Arakawa, Saitama-ken, all of (JP)

(73) Assignee: Hitachi Metals, Ltd., Tokyo (JP)

( * ) Notice: Subject to any disclaimer, the term of this patent is extended or adjusted under 35 U.S.C. 154(b) by 5 days.

(21) Appl. No.: 09/741,190

(22) Filed: Dec. 21, 2000

(30) Foreign Application Priority Data

Dec. 28, 1999 (JP) ..... 11-373237

(51) Int. Cl.[7] ..... B22D 11/06; B22D 11/00
(52) U.S. Cl. ..... 164/463; 164/477
(58) Field of Search ..... 164/463, 423, 164/477, 417

(56) References Cited

U.S. PATENT DOCUMENTS 5,740,853 A 4/1998 Tsuchihashi et al.

FOREIGN PATENT DOCUMENTS

JP 57094453 A 6/1982
JP 02055647 A 2/1990

*Primary Examiner*—Kuang Y. Lin
(74) *Attorney, Agent, or Firm*—Sughrue Mion, PLLC

(57) ABSTRACT

A method for winding a rapidly quenched thin metal ribbon has the steps of (1) ejecting a molten metal onto a rotating cooling roll to rapidly solidify the molten metal to form a thin metal ribbon, (2) peeling the thin metal ribbon from the cooling roll to let the thin metal ribbon to freely move from the cooling roll, and (3) bringing a rotating winding roll having an adhesive thereon into contact with the freely moving thin metal ribbon at an intermediate point thereof, so that the thin metal ribbon is wound around the winding roll with an excess portion of the thin metal ribbon forward of the intermediate point cut off.

4 Claims, 2 Drawing Sheets

METHOD FOR WINDING RAPIDLY QUENCHED THIN RIBBON, APPARATUS FOR PRODUCING RAPIDLY QUENCHED THIN RIBBON, AND RAPIDLY QUENCHED THIN RIBBON COIL

FIELD OF THE INVENTION

The present invention relates to a method for continuously and stably winding a rapidly quenched thin metal ribbon, an apparatus for producing a rapidly quenched thin metal ribbon, and a coil of a rapidly quenched thin metal ribbon produced by using the above method.

PRIOR ART

A rapid quenching method of a molten metal is widely known for the production of thin metal ribbons. The rapid quenching method includes, for example, a single-roll method comprising ejecting a molten metal onto a cooling roll rotating at a high speed to rapidly solidify the molten metal to obtain a thin metal ribbon, and a twin-roll method comprising feeding a molten metal between a pair of cooling rolls rotating at a high speed to produce a thin metal ribbon. To continuously wind the thin metal ribbon produced by these methods, various methods have been proposed heretofore. For example, Japanese Patent Laid-Open No. 57-94453 discloses a method comprising rapidly solidifying a thin metal ribbon on a cooling roll, peeling the rapidly solidified thin metal ribbon from the cooling roll using a high-pressure gas jet, and allowing a winding roll having a permanent magnet such as a permanent SmCo magnet embedded in a surface rotating at about the same surface speed as the cooling roll to magnetically attract the front end portion of the peeled thin metal ribbon, thereby continuously winding the thin metal ribbon.

Japanese Patent Laid-Open No. 8-318352 proposes a method using winding roll having an electromagnet embedded in a surface, the electromagnet being actuated at the start of winding to attract the font end of a thin metal ribbon. In each of these methods, a thin metal ribbon is continuously wound while a winding roll rotates. However, each method is disadvantageous, for example, in that the winding roll has a complex structure requiring troublesome maintenance.

Besides, there is proposed a method of winding a thin metal ribbon not from its front end portion but from its intermediate portion. As such a method, Japanese Patent Laid-Open No. 2-55647 proposes a method comprising leading a thin metal ribbon to an additional course with a guide, cutting the thin metal ribbon with a cutter, and then returning the cut thin metal ribbon to a regular course for winding.

Though the method of Japanese Patent Laid-Open No. 2-55647 is effective in that an undesirable forward excess portion of the thin metal ribbon is cut away, a very high skill is needed to lead a thin metal ribbon by a guide and cut it by a cutter in the case of a thin metal ribbon produced by high-speed casting.

In general, because the front end portion of a thin metal ribbon supplied from a cooling roll unstably moves, it is very difficult to lead the front end portion of the thin metal ribbon to an intended course in which a winding roll is positioned.

OBJECT OF THE INVENTION

Accordingly, an object of the present invention is to provide a method for winding a rapidly quenched thin metal ribbon continuously and stably using an apparatus of simple structure and easy maintenance, an apparatus for winding a rapidly quenched thin metal ribbon, and a rapidly quenched thin metal ribbon coil.

SUMMARY OF THE INVENTION

In view of the above object, the inventors have found that a thin metal ribbon supplied from a cooling roll would easily be wound, if the thin metal ribbon were let to freely move from the cooling roll, and if winding were started by bringing a winding roll having an adhesive on a surface into contact with the freely moving thin metal ribbon at an intermediate point thereof after the free movement of the thin metal ribbon has become stabile. The present invention has been completed based on this finding.

The present invention provides a method for winding a rapidly quenched thin metal ribbon, comprising the steps of (1) ejecting a molten metal onto a rotating cooling roll to rapidly solidify the molten metal to form a thin metal ribbon, (2) peeling the thin metal ribbon from the cooling roll to let the thin metal ribbon to freely move from the cooling roll, and (3) bringing a rotating winding roll having an adhesive thereon into contact with the freely moving thin metal ribbon at an intermediate point thereof, so that the thin metal ribbon is wound around the winding roll with an excess portion of the thin metal ribbon forward of the intermediate point cut off.

The present invention also provides an apparatus for producing a rapidly quenched thin metal ribbon, comprising a crucible for containing a molten metal; a feeder equipped with a nozzle for ejecting the molten metal; a rotary cooling roll for rapidly solidifying the molten metal ejected from the nozzle on a surface thereof to form a thin metal ribbon; and a rotary winding roll having an adhesive thereon, wherein the winding roll is brought into contact with the freely moving thin metal ribbon at an intermediate point thereof, so that the thin metal ribbon is wound around the winding roll with an excess portion of the thin metal ribbon forward of the intermediate point cut off.

In the apparatus of the present invention, the winding roll is preferably movable toward and away from a free movement course of the thin metal ribbon, the winding roll being positioned away from the free movement course of the thin metal ribbon until the free movement of the thin metal ribbon becomes stable, and the winding roll being moved to a position at which it is brought into contact with the freely moving thin metal ribbon after the free movement of the thin metal ribbon becomes stable.

Upon brought into contact with the winding roll having an adhesive on a surface, the freely moving thin metal ribbon is suddenly pulled in a rotational direction of the winding roll, different from the free movement direction, whereby the thin metal ribbon is broken substantially at a contact point, leaving an excess portion of the thin metal ribbon forward of the contact position cut off. To ensure that the thin metal ribbon is broken substantially at a point of contact with the winding roll having an adhesive on a surface, the surface speed of the winding roll is preferably 0.1 to 2.0% higher than the surface speed of the cooling roll.

The present invention further provides a rapidly quenched thin metal ribbon coil wound around a winding roll having an adhesive thereon, wherein an end of the thin metal ribbon, from which the thin metal ribbon starts to be wound around the winding roll, is a cut end, with a forward excess portion of the thin metal ribbon cut off.

BEST MODE OF THE INVENTION

Figure 1:
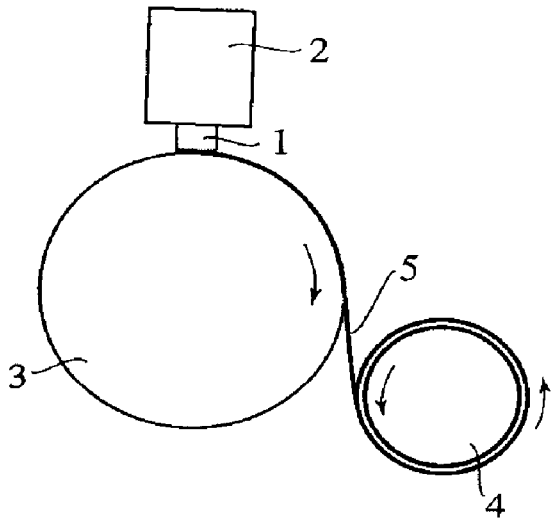
FIG. 1 is a schematic view showing a process for producing and winding a rapidly quenched thin metal ribbon according to one embodiment of the present invention, at a stage where a freely moving thin metal ribbon is being wound around the winding roll.
Figure 2:
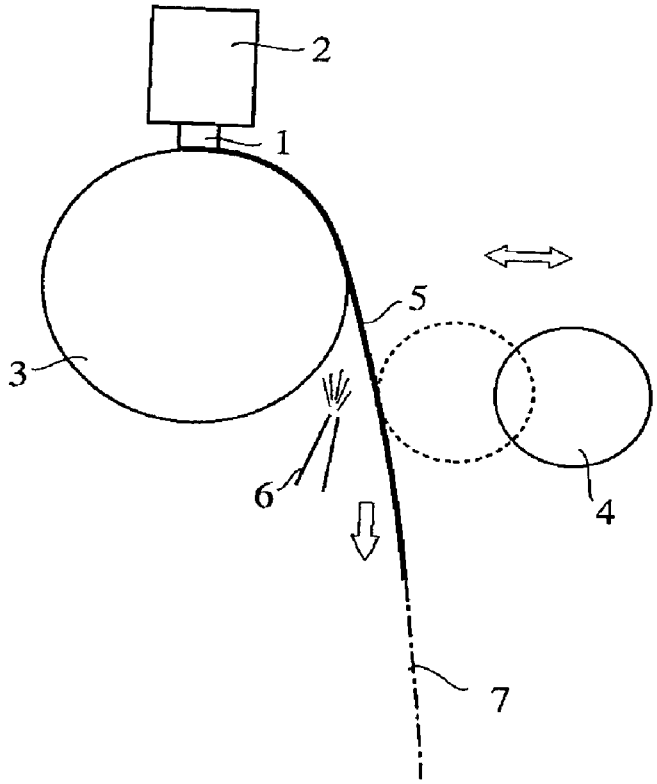
FIG. 2 is a schematic view showing a process for winding a rapidly quenched thin metal ribbon according to one embodiment of the present invention, at a stage before the winding roll is brought into contact with the freely moving thin metal ribbon.
Figure 3:
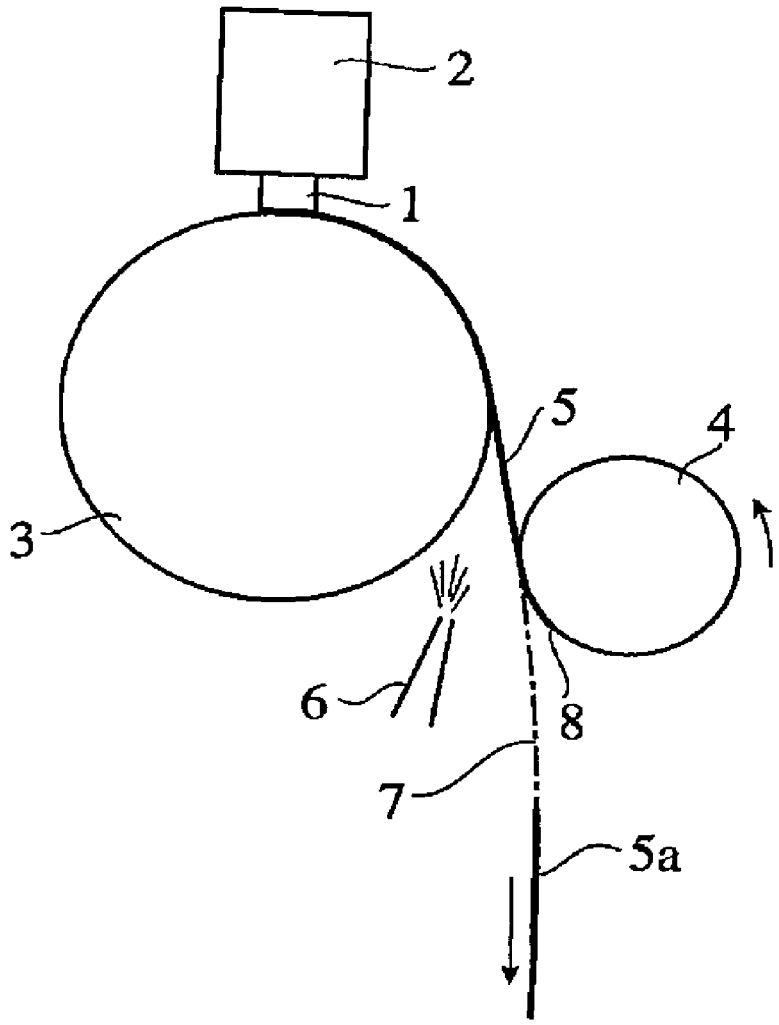
FIG. 3 is a schematic view showing a process for winding a rapidly quenched thin metal ribbon according to one embodiment of the present invention, at a stage where the thin metal ribbon is broken at a point of initial contact with the winding roll, so that a forward excess portion is cut off.

FIG. 1 shows the overall structure of an apparatus for producing a rapidly quenched thin metal ribbon by a single-roll method, one of the preferred methods for producing a rapidly quenched thin metal ribbon according to the present invention. FIGS. 2 and 3 schematically show bow winding is conducted using the apparatus of FIG. 1.

Referring to FIG. 1, the apparatus of the present invention comprises a feeder constituted by a crucible 2 and a nozzle 1 fitted to the bottom of the crucible 2, a rotatable cooling roll 3 disposed under the feeder with a slight gap between the tip end of the nozzle 1 and the surface of the cooling roll 3, and a winding roll 4 rotatable in an opposite direction to that of the cooling roll 3. The winding roll 4 has an adhesive on a surface thereof. A molten metal contained in the crucible 2 is ejected through the nozzle 1 onto a surface of the cooling roll 3 rotating at a high speed, so that it is rapidly solidified to form a thin metal ribbon 5.

As shown in FIG. 2, the thin metal ribbon 5 attached to the cooling roll 3 is peeled from the cooling roll 3 by a high-pressure gas ejected from a nozzle 6 and let to move freely. Accordingly, the thin metal ribbon 5 leaving from the cooling roll 3 freely moves along a parabola 7 starting from a point at which the thin metal ribbon departs from the cooling roll 3.

At an initial stage at which the free movement of the thin metal ribbon 5 has not reached a stable state, the winding roll 4 is located at a distant position so that it does not contact with the freely moving thin metal ribbon 5. Since a longer period of time in free movement results in a lower yield of the thin metal ribbon 5, the time period of free movement is preferably 5 to 10 seconds.

The winding roll 4 is moved toward the free movement course of the thin metal ribbon 5 until it is brought into contact with the freely moving thin metal ribbon 5, as indicated by the broken line in FIG. 2. Upon being contacted with the winding roll 4, it is bonded to the adhesive on the surface of the winding roll 4, whereby it is suddenly pulled in a rotational direction of the winding roll 4, subjected to a bending force. Because the thin metal ribbon 5, usually amorphous, is thin, rapid bending results in the breakage of the thin metal ribbon 5. Therefore, the thin metal ribbon 5 is cut near the contact point 8, with the forward excess portion 5*a* cut away. Because the cut end is bonded to the surface of the winding roll 4, the thin metal ribbon 5 is wound around the winding roll 4 without laxation. The production of the rapidly quenched thin metal ribbon 5 usually lasts from several minutes to several hours.

An important feature of the present invention is that the winding roll 4 has an adhesive on a surface thereof to capture the thin metal ribbon 5 freely moving from the cooling roll 3 at a high speed. A preferred adhesive is a double-coated adhesive tape, because it can be easily adhered to both the surface of the winding roll 4 and the freely moving thin metal ribbon 5. The adhesive power of the double-coated adhesive tape is desirably as high as possible, and adhesive power of 0.25 N/mm or more per width at 180° peeling is sufficient to ensure that the freely moving thin metal ribbon 5 is bonded to the rotating winding roll 4 without fail.

At the time of contact of the rotating winding roll 4 with the freely moving thin metal ribbon 5, the surface speed of the winding roll 4 is preferably 0.1 to 2.0% higher than the surface speed of the cooling roll 3, because the thin metal ribbon 5 is not loosened at this speed when the winding roll 4 is brought into contact with the thin metal ribbon 5, thereby achieving stable winding free from Taxation. When the surface speed of the winding roll 4 is less than 100.1% relative to the surface speed of the cooling roll 3, the thin metal ribbon 5 is largely loosened, tending to break. On the other hand, when the surface speed of the winding roll 4 is more than 102.0% relative to the surface speed of the cooling roll 3, the thin metal ribbon 5 is often broken by an excessive tension when the thin metal ribbon 5 is brought into contact with the rotating winding roll 4. The surface speed of the winding roll 4 is preferably 0.5 to 1.0% higher than the surface speed of the cooling roll 3. After the winding roll 4 comes into contact with the thin metal ribbon 5, the winding roll 4 is adjusted to rotate substantially at the same surface speed as the cooling roll 3. To achieve this, the winding roll 4 is preferably provided with a powder clutch, for instance.

With the above mechanism of the winding roll 4, a proper tension is applied to the thin metal ribbon 5 during winding. The tension applied to the thin metal ribbon S is preferably 10 to 100 MPa. If the tension were too low, the thin metal ribbon 5 would be wound loosely, resulting in extreme tilting of the wound thin metal ribbon 5 on the winding roll 4 when a long thin metal ribbon 5 is wound. On the other hand, if the tension were too high, the thin metal ribbon 5 would tend to be cut in the course of winding. The more preferred tension is 30 to 60 MPa.

To reduce the loosening of the thin metal ribbon 5 at a moment when the rotating winding roll 4 is brought into contact with the freely moving thin metal ribbon 5, a pressing plate for pressing the moving thin metal ribbon 5 to the cooling roll 3 may be used as an additional apparatus.

By using the apparatus of the present invention, the freely moving thin metal ribbon 5 can be attached to the rotating winding roll 4 at a very small distance between the cooling roll 3 and the winding roll 4, for instance, 1 to 20 mm. After the winding roll 4 starts winding the thin metal ribbon 5 stably, it is necessary to move the winding roll 4 such that it is always kept away from the cooling roll 3 to prevent the increasing thin metal ribbon 5 wound around the winding roll 4 from coming into contact with the cooling roll 3.

Another important feature of the present invention is that the freely moving thin metal ribbon 5 is brought into contact with the rotating winding roll 4 such that a forward excess portion 5*a* of the thin metal ribbon 5 can be cut. As shown in FIG. 3, after the free movement of the thin metal ribbon 5 becomes stable, the thin metal ribbon 5 is brought into contact with the winding roll 4 at an intermediate point (contact point) 8 downstream of the front end of the thin metal ribbon 5, permitting a forward excess portion 5*a* of the thin metal ribbon 5 to be cut away. The mechanism that the forward excess portion 5*a* is cut away while being wound around the winding roll 4 is not necessarily clear. However, it is presumed that the movement direction of the thin metal ribbon 5 is suddenly changed at the contact point 8 at which the thin metal ribbon 5 starts to be in contact with the winding roll 4, whereby the forward excess portion 5*a* is suddenly bent near the contact point 8. The forward excess portion 5*a* is surely cut away upon contact with the winding roll 4 with an adhesive on a surface, ensuring that only a necessary portion of the thin metal ribbon 5 is wound around the winding roll 4 stably.

The present invention can be applied to the production of a thin metal ribbon of not only an amorphous alloy, but also a nanocrystalline alloy having an average grain diameter of 100 nm or less, which is obtained by heat-treating an amorphous alloy.

Thus, there can be obtained a coil of a rapidly quenched thin metal ribbon which is wound around a winding roll having an adhesive thereon, with a forward excess portion cut off.

In a preferred embodiment of the present invention, the winding roll 4 is desirably made of metal materials such as lightweight Al alloys or the like, because an apparatus of simple structure and easy maintenance is required. Further, because a thin amorphous alloy ribbon 5 peeled from the cooling roll 3 is up to 300° C. on a surface, it would become too brittle if it were not quenched. Therefore, the winding roll should have a high thermal conductivity. A cooling medium such as compressed air may be sprayed onto the winding roll 4 to increase the cooling ability thereof.

Since the rapidly solidified thin metal ribbon 5 rotates while being attached to the cooling roll 3, it is preferred to apply a jet of a high-pressure inert gas (e.g. compressed air or nitrogen) to peel the thin metal ribbon 5 from the cooling roll 3 to let the thin metal ribbon 5 to move freely. In this case, it is desired to control the pressure and direction of a gas jet so that the thin metal ribbon 5 makes stable flight without flapping. A low gas pressure makes peeling difficult, while a high gas pressure causes the flapping of the thin metal ribbon 5. Therefore, the gas pressure is preferably 50 to 400 kPa in terms of gauge pressure. The direction of the gas jet applied is preferably 20 to 40° relative to the tangential direction of the cooling roll 3, because this range allows stable peeling. The direction of the gas jet is more preferably 25 to 30°.

The present invention will be described in detail referring to EXAMPLES below without intention of limiting the present invention thereto.

EXAMPLE 1, COMPARATIVE EXAMPLE 1

An ingot of an alloy having a composition of $Fe_{74}Cu_1Nb_3Si_{15.5}B_{6.5}$ (atomic %) was fed into a crucible 2 and melted by high-frequency induction. The molten alloy was ejected through a nozzle 1 mounted to the crucible 2 onto a cooling roll 3 made of a CuBe alloy in a single-roll rapidly quenching apparatus shown in FIG. 1 for rapid solidification, to produce a thin amorphous alloy ribbon 5 having a width of 25 mm and a thickness of 18 $\mu$m. The surface speed of the cooling roll 3 was 30 m/s. This alloy was capable of being turned to have a nanocrystalline structure having an average grain diameter of 100 nm or less by a proper heat treatment.

The resultant thin amorphous alloy ribbon 5 was wound around a winding roll 4 made of an Al alloy and rotating at a surface speed of 30.3 m/s. A double-coated adhesive tape having a width of 40 mm and an adhesive power of 0.41 N/mm per width was attached onto a peripheral surface of the winding roll 4 in such a length as to just cover the circumference. The thin metal ribbon 5 was peeled from the cooling roll 3 by using a jet of high-pressure nitrogen gas of 250 kPa (gauge pressure). The direction of the gas jet was 30° relative to the tangential direction of the cooling roll 3. The distance between the cooling roll 3 and the winding roll 4 at the start of winding was 10 mm, and the tension during winding was 50 MPa. The winding of the thin metal ribbon 5 started 7 seconds by bringing the winding roll 4 into contact with the freely moving thin metal ribbon 5, after the thin metal ribbon was let to move freely from the cooling roll 3.

In Comparative Example 1, the thin metal ribbon 5 was wound by the winding roll 4 immediately peeling from the cooling roll 3, meaning that there was no free movement of the thin metal ribbon 5. The free movement time of the thin metal ribbon 5 was zero second. Other conditions were the same as in EXAMPLE 1.

After the thin metal ribbon 5 was bonded to the adhesive on the winding roll, the thin metal ribbon 5 was wound around the winding roll 4 for 7 seconds without changing the position. As the winding roll 4 became increasingly fat, the position retreated gradually. Winding was conducted by 10 charges in both EXAMPLE 1 and COMPARATIVE EXAMPLE 1. As a result, when winding was conducted without free movement (COMPARATIVE EXAMPLE 1), the thin metal ribbon 5 was easily broken, resulting in the chance of successful winding of as low as 30%.

Meanwhile, in the winding of the present invention, the chance of success was 100%, confirming that at a moment when the rotating winding roll 4 was brought into contact with the freely moving thin metal ribbon 5, the forward excess portion of the thin metal ribbon 5 could be cut off without fail.

According to the present invention, there are provided a method for winding a rapidly quenched thin metal ribbon continuously and stably by using an apparatus of simple structure and easy maintenance; an apparatus for producing a rapidly quenched thin metal ribbon; and a rapidly quenched thin metal ribbon coil.

What is claimed is:

1. A method for winding a rapidly quenched thin metal ribbon, comprising the steps of (1) ejecting a molten metal onto a rotating cooling roll to rapidly solidify said molten metal to form a thin metal ribbon, (2) peeling said thin metal ribbon from said cooling roll to let said thin metal ribbon to freely move from said cooling roll, and (3) bringing a rotating winding roll having an adhesive thereon into contact with the freely moving thin metal ribbon at an intermediate point thereof, so that said thin metal ribbon is wound around said winding roll with an excess portion of said thin metal ribbon forward of said intermediate point cut off.

2. The method for winding a rapidly quenched thin metal ribbon according to claim 1, wherein a forward excess portion of said thin metal ribbon is cut off substantially at said intermediate point upon contact with said winding roll.

3. The method for winding a rapidly quenched thin metal ribbon according to claim 1, wherein said winding roll is brought into contact with said freely moving thin metal ribbon at a surface speed of 0.1 to 2.0% higher than the surface speed of said cooling roll.

4. The method for winding a rapidly quenched thin metal ribbon according to claim 2, wherein said winding roll is brought into contact with said freely moving thin metal ribbon at a surface speed of 0.1 to 2.0% higher than the surface speed of said cooling roll.

* * * * *